United States Patent [19]

Allen et al.

[11] Patent Number: 4,586,553

[45] Date of Patent: May 6, 1986

[54] PISTONS

[75] Inventors: Gordon L. Allen, Rugby; Robert Munro; Roger A. Day, both of Lymington, all of England

[73] Assignee: AE PLC, Warwickshire, England

[21] Appl. No.: 507,568

[22] Filed: Jun. 24, 1983

[30] Foreign Application Priority Data

Jun. 25, 1982 [GB] United Kingdom ..... 8218498

[51] Int. Cl.[4] ..... B22C 9/10

[52] U.S. Cl. ..... 164/30; 164/99; 164/340; 164/397

[58] Field of Search ..... 164/97–99, 164/30–32, 120, 319, 340, 397–399, 366, 367, 80

[56] References Cited

U.S. PATENT DOCUMENTS 2,004,661 6/1935 Jardine ..... 164/366
3,991,811 11/1976 Diez et al. ..... 164/397 X

FOREIGN PATENT DOCUMENTS 53-138409 12/1978 Japan ..... 164/98
1598585 9/1981 United Kingdom ..... 164/99

*Primary Examiner*—Nicholas P. Godici
*Attorney, Agent, or Firm*—Leydig, Voit & Mayer, Ltd.

[57] ABSTRACT

A process is provided for pressure casting a piston with a crown insert and a cavity. The process comprises casting crown down in a mould and, before casting, placing in the mould means for forming a crown insert and a soluble salt core forming a cavity in the piston. The salt core is held by the crown insert means to position the salt core in the mould so preventing the salt core moving during pressure casting.

2 Claims, 5 Drawing Figures

PISTONS

BACKGROUND TO THE INVENTION

1. Field of the Invention

The invention relates to pistons and more particularly to the pressure casting of pistons with crown inserts and cavities in the casting for the circulation of coolants.

2. Review of the Prior Art

In the conventional gravity casting of pistons, a known method of forming such cavities comprises formation of a soluble core in the shape of the required cavity and then placing the core in a required position in the mould before the piston is cast. Such cores are commonly of a salt such as sodium chloride but may be of any alternative soluble salt or mixture of salts. Where gravity die cast pistons are cast "crown down" (i.e. with the crown lowermost), the salt core can either be connected to the mould core and lowered into the other mould member with the mould core. Alternatively the salt core can be positioned in the lower mould member by the formation of the salt core with integral salt legs which enable the salt core to stand on the base of the lower mould member or, where such is provided, on a crown insert also placed in the lower mould member. After casting the salt is flushed out with a suitable solvent to leave a cavity for the circulation of coolants.

In recent years, attention has been directed to the pressure casting (for example squeeze casting) of pistons. In such a casting technique, the molten piston metal is solidified under pressure to produce a casting whose structure is particularly homogeneous and free from voids and which is therefore stronger than a gravity die casting. In general, in pressure casting, the piston is cast "crown down" in order to ensure that the molten metal first entering the die does not solidify before pressure is fully applied.

The formation of cavities in such pressure cast castings by the use of salt cores is, however, a problem because the methods described above for use in gravity die casting cannot be successfully used. If the salt core is connected to the mould core, there is a possibility both of damage to the salt core and incorrect location of the salt core because the mould members continue to move relatively to one another during solidification of the casting as a result of contraction of the casting under pressure. If the salt core stands on salt legs, the pressure is often sufficient to cause the molten metal to penetrate the salt legs, thus making the salt core difficult to flush out. The pressure may also cause the salt legs to fracture, so allowing movement of the salt core out of position.

SUMMARY OF THE INVENTION

According to a first aspect of the invention, there is provided a process for pressure casting a piston with a crown insert and a cooling cavity in the piston crown using a mould having upper and lower mould members, the method comprising casting the piston crown down in a mould and, before casting, placing in the lower mould member a crown insert and a soluble salt core, the salt core being held by the crown insert to position the salt core in the lower mould member, filling the lower mould member with molten metal, closing the mould with the upper mould member and then solidifying the molten metal under pressure.

According to a second aspect of the invention there is provided a piston when made by the method of the first aspect of the invention.

BRIEF DESCRIPTION OF THE DRAWINGS

The following is a more detailed description of some embodiments of the invention, by way of example, reference being made to the accompanying drawings, in which.

DESCRIPTION OF THE PREFERRED EMBODIMENTS

All the piston castings to be described with reference to the drawings are produced by a 'crown down' casting method in which the crown of the piston casting is formed at the base of a mould. In addition, the casting method is a pressure casting method, preferably a squeeze casting method, using a stationary lower mould part and a movable upper mould core. The upper mould core is separated from the lower mould part and the lower mould part is filled with molten casting metal. The mould core is then moved into the lower mould part initially to close the mould and then to reduce the volume of the mould, thus ensuring that the molten metal solidifies under pressure so reducing voids and pores in the casting and thereby strengthening the casting.

In order to minimise the weight of pistons, they are commonly cast in aluminium or an aluminium alloy. These metals are not, however, best suited to withstand the high temperatures encountered in the combustion chamber of an internal combustion engine. For this reason, pistons can be provided with an insert in the crown which is of a material which is more heat resistant than the material of the body of the piston.

In addition, in order to allow a coolant, such as oil, to remove heat from the crown end of the piston, this part of the piston can be provided with a cavity through which the coolant circulates from the interior of the piston.

The embodiments of the invention now to be described with reference to the drawings are all pressure casting processes for incorporating such inserts into piston castings while forming cavities in the casting.

Figure 1:
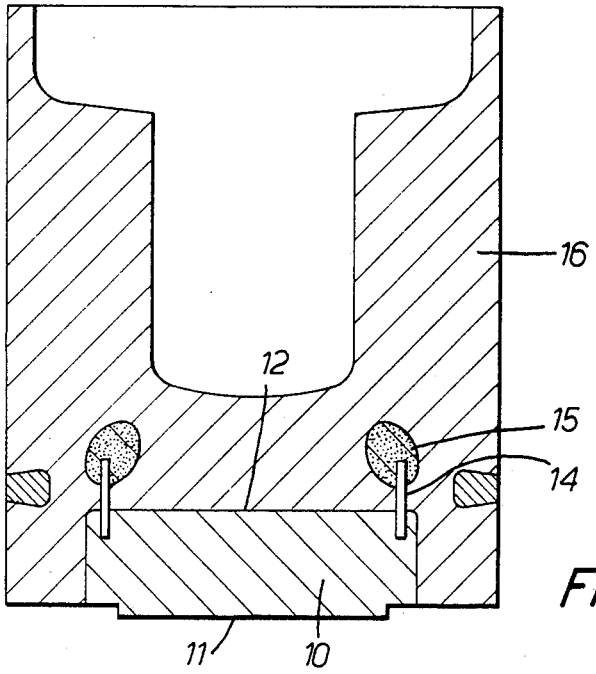
FIG. 1 is a vertical cross-section of a piston casting including a crown insert and a salt core attached to the crown insert by wires.

Referring first to FIG. 1, an insert 10 is precast from an aluminium alloy such as LO-EX aluminium alloy or a Y-alloy or derivative. The insert 10 is generally cylindrical with two flat faces 11, 12, one of which 11, forms the crown face in the finished piston and the other of which has a plurality of wire pins 14 extending upwardly therefrom and arranged around the periphery of the surface. An annular soluble salt core 15 is carried on the pins and is thus held by the insert 10. The position of the core 15 relatively to the insert 10 is the same as the required position of the cavity relatively to the insert 10 in the casting.

The salt may be sodium chloride or any other suitable salt or mixture of salts.

The insert 10 and salt core 15 are placed in the lower mould part with the face 11 on the base of the mould. The piston is then squeeze cast as described above to produce a piston as shown in FIG. 1 in which the insert 10 is bonded to the casting 16 by the formation of an alloy between them. A hole or holes are then drilled through the solidified casting from the interior and the salt core flushed-out with solvent to leave a cavity and holes for the circulation of coolant.

Figure 2:
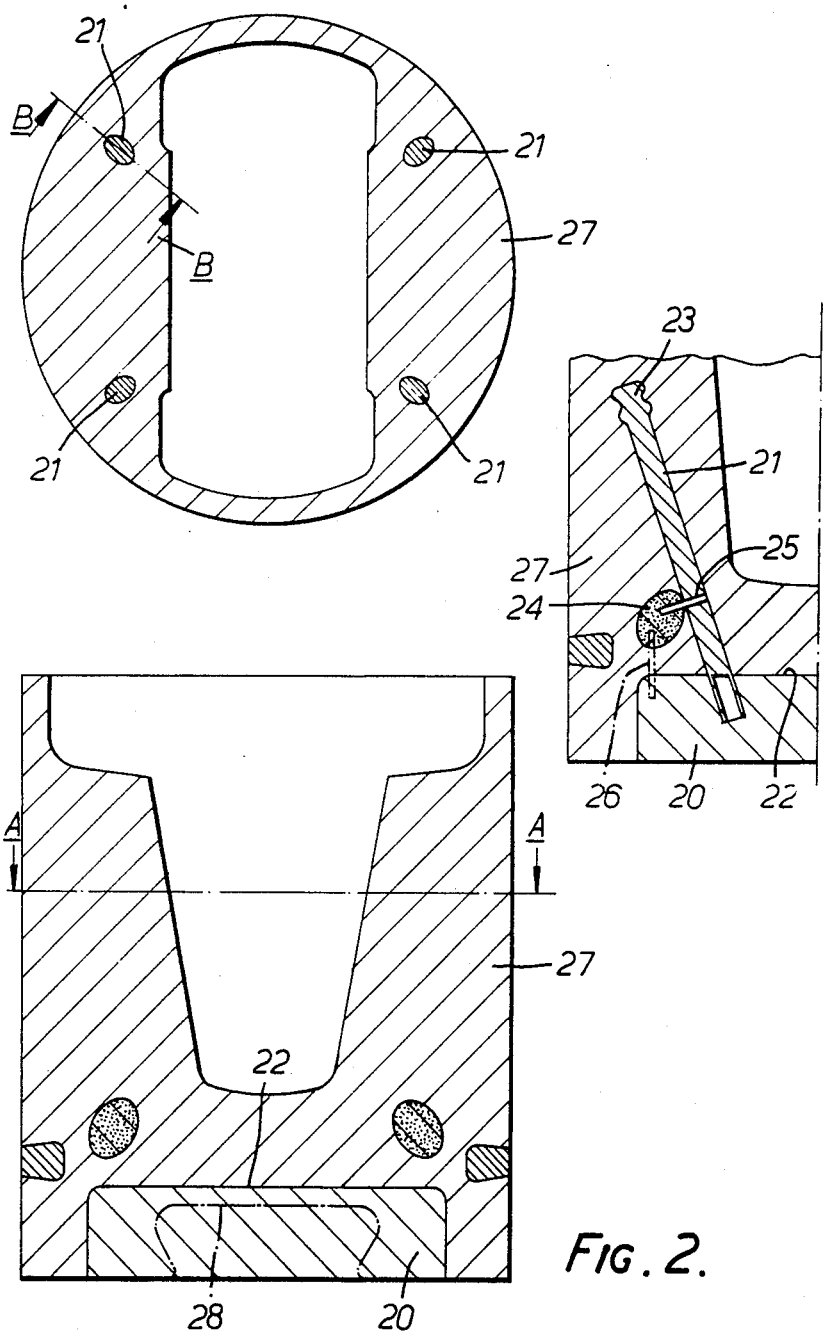
FIG. 2 shows a vertical cross-section, a section on the line A—A of the vertical cross-section, and a section on the line B—B of the A—A section, of a piston casting including a crown insert having legs, and a salt core shown in full line attached by wires to the legs and in broken line attached by wires to a body of the insert.

Referring next to FIG. 2, an insert 20 has generally a cylindrical body and is of a copper alloy. The insert also includes four legs 21 which extend at an angle from, or are normal to, and are equiangularly spaced around one surface 22 of the body. The legs 21 terminate in enlarged heads 23. An annular salt core 24 is placed around the legs 21 and is attached to the insert 20 either by wires 25 extending around the legs 21 and into the salt core 24 or by wires 26 extending into both the salt core 24 and the body of the insert 20. Thus the salt core 24 can be firmly located relatively to the insert in any required position.

The insert 20 and salt core 24 are then placed in the lower mould part and the casting performed as described above. The legs 21 lock the insert 20 to the casting 27 to ensure that the insert 20 is firmly located. Holes are drilled in the casting 27 to allow the salt core 24 to be flushed-out to form a cavity and inlet and outlet for coolant. The insert 20 is machined along the line 28 to form a reinforced re-entrant crown.

Figure 3:
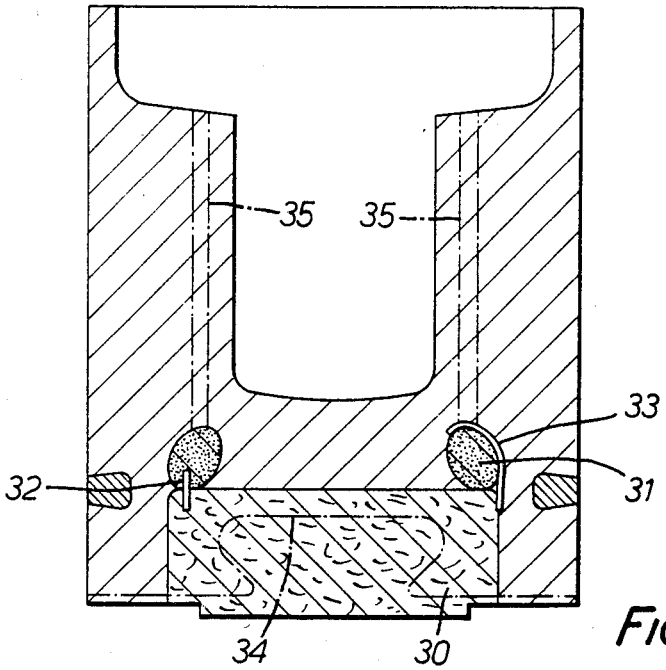
FIG. 3 is a vertical cross-section of a piston casting including a crown insert and a salt core which, to the left of the Figure, is attached to the crown insert by a wire extending into the salt core and, to the right of the Figure, is attached to the crown insert by a wire extending around the salt core.

Referring next to FIG. 3, an insert 30 is formed by a pad of fibres or wiskers of generally cylindrical shape. An annular salt core 31 rests on the surface of the insert 30 and is held in position either by wire pins 32 extending into the insert 30 and the salt core 31 (as shown to the left of FIG. 3) or by loops of wire 33 extending into the insert 30 and around the salt core 31 (as shown to the right of FIG. 3). Thus the salt core 31 is held firmly by the insert 30.

The insert 30 and the salt core 31 are then placed in the lower mould part and the casting performed, as described above. The molten metal penetrates the insert 30 to form a reinforced area which is machined along the line 34 to form a combustion chamber. Holes 35 are drilled through the casting 36 to allow the salt core 31 to be dissolved and to form a cavity and inlet and outlet passages for coolant.

Figure 4:
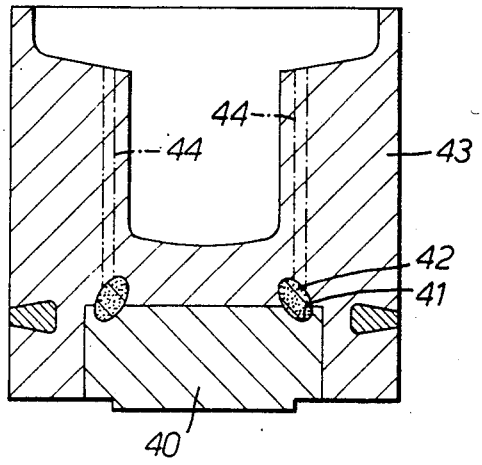
FIG. 4 is a vertical cross-section of a piston casting including a crown insert having a groove receiving a salt core.

Referring next to FIG. 4, an insert 40 is of generally the same shape and construction as either the insert 10 of FIG. 1 or the insert 30 of FIG. 3. The exterior surface of the insert 40 is provided with an annular groove 41 in which sits an annular salt core 42. The engagement of the groove 41 with the salt core 42 ensures that the core 42 is firmly located. An adhesive may be used to hold the salt core 42 in the groove 41.

The insert 40 and the salt core 42 are then placed in the lower mould part and casting continues as described above.

Due to the groove 41, the salt core is accurately located in the casting 43. When the casting is solidified, holes 44 are drilled through the casting and the salt core 41 dissolved with water to leave a cavity and inlet and outlet passages for coolant.

Figure 5:
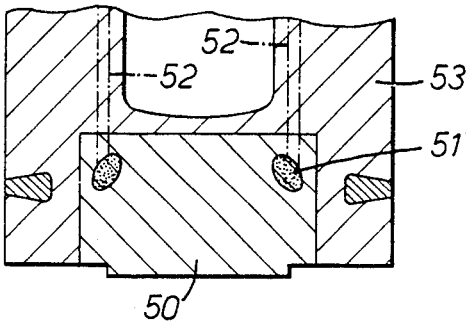
FIG. 5 is a vertical cross-section of a piston casting including a crown insert within which is located a salt core.

Referring finally to FIG. 5, an insert 50 is of generally the same shape and construction as the insert 10 of FIG. 2 or the insert 30 of FIG. 3. An annular salt core 51 is located within the insert 50 either by being cast into the insert 50, where this is of precast metal or by being embedded in the fibres or wiskers, where the insert 50 is made of such fibres or wiskers. The salt core 51 is thus firmly located by the insert 50.

The insert 50 and salt core 51 are then placed in the lower mould part and casting is performed, as described above. When the casting 53 has solidified, holes 52 are drilled through the casting 53 and the salt core 51 dissolved to leave an annular cavity and inlet and outlet holes for coolant.

It will be appreciated that in any of the embodiments described above with reference to the drawings in which wires or wire pins are used, the material of these wires may have a lower melting point than the temperature of the molten piston metal so that the wire melts on casting. The wire may be of a material such as pure aluminium which will dissolve in the molten piston material. It will also be appreciated that although a squeeze casting process has been described above, any other pressure casting process may also be used.

In all the above described embodiments of the invention, the salt core is held firmly by the insert, thus ensuring the accurate location of the salt core in the casting. By suitable arrangement of the length of the wires, where these are used, the salt core can be positioned at any required location in the casting. There are no salt legs to become infiltrated with molten metal. In addition, the salt core is well away from the mould core so preventing damage of the salt core by the mould core. As the casting contracts under pressure, the location of the salt core on the crown insert prevents movement of salt core.

We claim:

1. A process for pressure-casting a piston with a crown insert and a cooling cavity in the piston crown, comprising:

forming an annular salt core, preforming a piston insert of generally annular shape of cast metal, with a first surface, which is to form a surface of the finished piston, the annular soluble salt core being wholly within the piston insert, placing the precast piston insert including the annular salt core in an open lower mould member with said first insert surface on a base of the lower mould member, filling the open lower mould member with a molten metal, closing the lower mould member with an upper mould member, solidifying the molten metal under pressure to form a cast piston in which the precast piston insert is incorporated, to reinforce the crown of the piston, removing the upper mould member, extracting the cast crown reinforced piston, drilling the casting and the insert, and then flushing out the soluble salt core from the crown insert.

2. A process for pressure-casting a piston with a crown insert and a cooling cavity in the piston crown, comprising:

forming an annular salt core, preforming a piston insert of generally annular shape of fibers or whiskers, with a first surface, which is to form a surface of the finished piston, the annular soluble salt core being wholly within the piston insert, placing the preformed piston insert including the annular salt core in an open lower mould member with said first insert surface on a base of the lower mould member, filling the open lower mould member with a molten metal, closing the lower mould member with an upper mould member, solidifying the molten metal under pressure to form a cast piston in which the preformed piston insert is incorporated, to reinforce the crown of the piston, removing the upper mould member, extracting the cast crown reinforced piston, drilling the casting and the insert, and then flushing out the soluble salt core from the crown insert.

* * * * *